US005671871A

United States Patent [19]

Hoare

[11] Patent Number: 5,671,871

[45] Date of Patent: Sep. 30, 1997

[54] INSERTS FOR CONTAINERS

[75] Inventor: Anthony Robert Hoare, Portishead, United Kingdom

[73] Assignee: David S. Smith (Packaging) Limited, Warwickshire, United Kingdom

[21] Appl. No.: 512,212

[22] Filed: Aug. 7, 1995

[30] Foreign Application Priority Data

Aug. 6, 1994 [GB] United Kingdom ..... 9415948

[51] Int. Cl.[6] ..... B65D 35/18

[52] U.S. Cl. ..... 222/105; 222/107; 222/464.1

[58] Field of Search ..... 222/92, 95, 105, 222/107, 464.1, 464.2

[56] References Cited

U.S. PATENT DOCUMENTS

| | | | |
|---|---|---|---|
| Re. 33,969 | 6/1992 | Richter | 222/105 X |
| 349,651 | 9/1886 | Jacobs | 222/464.2 X |
| 3,486,661 | 12/1969 | Friedrich et al. | 222/95 |
| 4,013,195 | 3/1977 | Ferris | 222/95 |
| 5,292,033 | 3/1994 | Gueret | 222/105 X |

FOREIGN PATENT DOCUMENTS

| | | | |
|---|---|---|---|
| 0 138 620 | 4/1985 | European Pat. Off. . | |
| A-598 255 | 5/1994 | European Pat. Off. . | |
| 755624 | 11/1954 | United Kingdom | 222/95 |
| WO85/0483 | 10/1985 | WIPO . | |

*Primary Examiner*—Andres Kashnikow
*Assistant Examiner*—Kenneth Bomberg
*Attorney, Agent, or Firm*—Adams Law Firm, P.A.

[57] ABSTRACT

An insert for a collapsible container having an opening. The insert includes a first fluid passage defining member having a generally U-shaped lateral cross-section. This member extends from the opening inwardly of the container and is in fluid communication with the opening. The insert also includes a second fluid passage defining member having a generally U-shaped lateral cross-section. The second member extends transversely from the first member and is in fluid communication therewith.

13 Claims, 2 Drawing Sheets

INSERTS FOR CONTAINERS

FIELD OF THE INVENTION

This invention relates to inserts for containers. More particularly, but not exclusively, this invention relates to inserts for collapsible containers used to hold a viscous material, such as ink.

DISCUSSION OF THE PRIOR ART

Viscous materials such as ink are often supplied in collapsible containers. The disadvantage of such containers is that, when almost empty, the sides of the container come into contact with each other thereby creating pockets of fluid which are difficult to dispense.

Attempts have been made to overcome this problem. One such attempt is described in European Patent Specification No. EP-A-0176564 and comprises a flexible strip disposed in a container. Another such attempt is described in EP-A-0138620 which discloses a channel formed, or mounted on one of the inside walls of the container. A disadvantage of such methods is that there are still problems in dispensing all the fluid from the container.

It is an object of this invention to obviate and/or mitigate this disadvantage.

SUMMARY OF THE INVENTION

According to one aspect of this invention there is provided an insert for a collapsible container having an opening, said insert comprising a first member defining a first fluid passage adapted to extend from said opening inwardly of the container and adapted to be arranged in fluid communication with said opening, and a second member defining a second fluid passage extending transversely from said first fluid passage and being in fluid communication with said first fluid passage.

Preferably the insert further includes a third member defining a third fluid passage extending transversely from said first fluid passage and being in fluid communication with said first fluid passage. The third member is desirably spaced from the second member and may extend from the first member in the same direction as the second member.

The first, second and third members may be rigid. The second member may be rigidly connected to the first member. The third member may be rigidly connected to the first member. The insert may further include a spout defining a conduit therethrough and adapted to be arranged at said opening. Preferably the first member is rigidly mounted on the spout with the first fluid passage in communication with the conduit, there being substantially no movement of said first fluid passage defining member relative to said spout.

Alternatively the first member is formed integrally with the spout. Preferably, the first member and the spout are rigidly connected to each other.

Preferably, each fluid passage is elongate and may define a channel for the passage of fluid. Preferably, each member comprises a substantially flat portion and walls arranged on said flat portion to define a channel on each side of the flat portion. Preferably intermediate longitudinally extending walls sub-divide each channel into two or more sections.

Preferably the flat portion of the first member extends across a conduit through the spout to divide flow of fluid therethrough into two streams.

Preferably, the spacing between the second and third members is proportional to the size of the container.

The second and third members may extend substantially perpendicularly from the first member and may be substantially parallel to each other. The ratio of the height of the wall members to the width of the flat member may be in the range of 1:1 to 1:6 preferably the ratio of the height to the width is 1:3 to 1:5 and, more preferably 1:4.

According to another aspect of this invention there is provided a collapsible container for a fluid material comprising a flexible vessel for holding said fluid material, an opening for dispensing said fluid and an insert as described in any of paragraphs 5 to 12 above.

Preferably, the insert comprises a spout having a conduit therethrough, said spout being adapted to be provided at said opening and said conduit being, in use, in fluid communication with the inside of said vessel via said opening, the first member being preferably mounted on said spout.

BRIEF DESCRIPTION OF THE DRAWINGS

An embodiment of the invention will now be described by way of example only with reference to the accompanying drawings in which.

DETAILED DESCRIPTION

Figure 1:
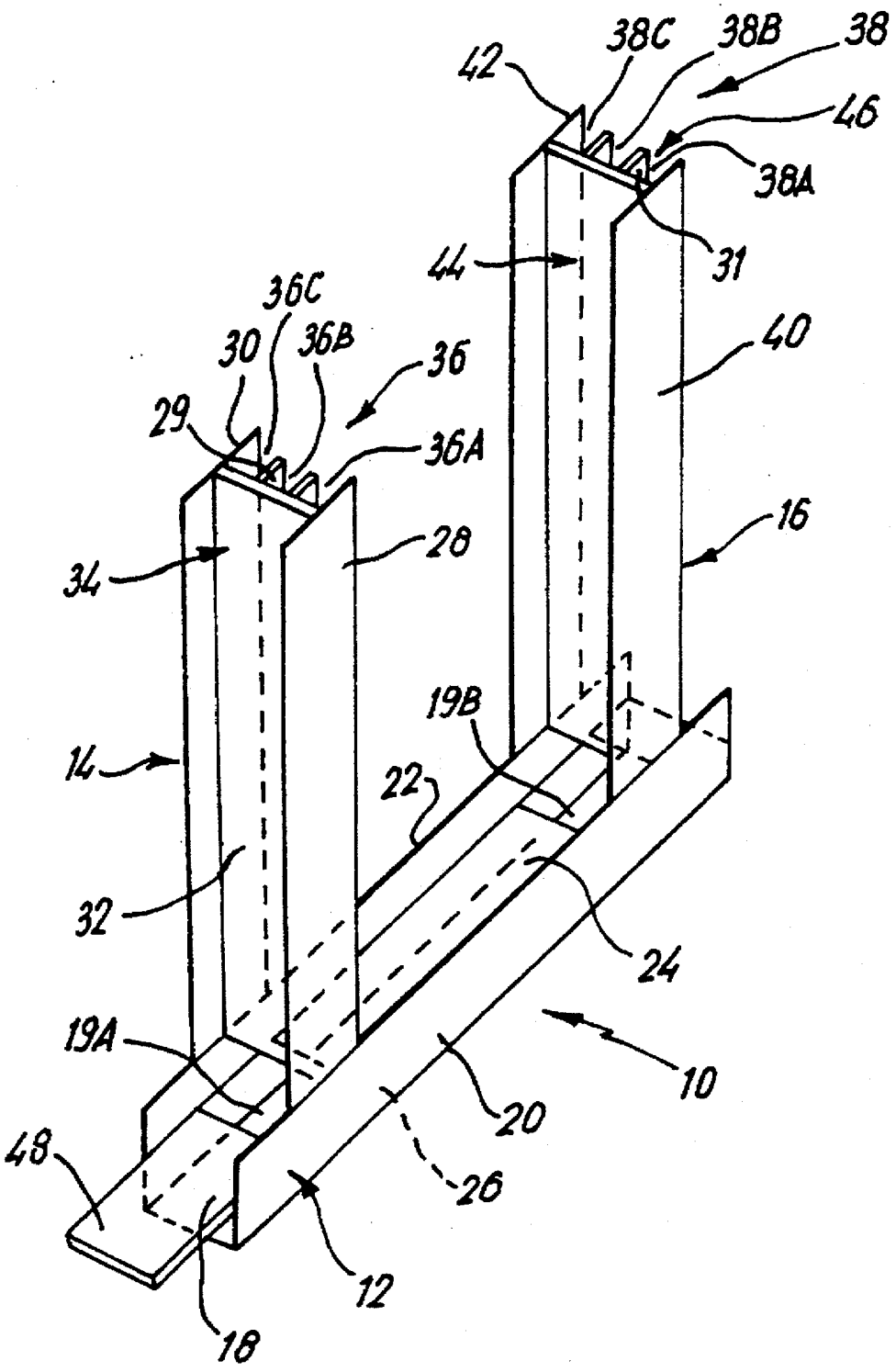
FIG. 1 is a perspective view of an insert.

Referring to FIG. 1, there is shown an insert 10 which comprises a first member in the form of a first channel member 12, and a second member in the form of a second channel member 14. The insert also comprises a third member in the form of a third channel member 16. The first, second and third channel member 12, 14 and 16 are provided to allow fluid flow from inside a container to the spout to dispense said fluid, particularly when the container is almost empty.

The first channel member 12 comprises a substantially flat portion 18 and first and second wall members 20, 22 extending substantially vertically from the substantially flat portion 18. The walls 20, 22 are arranged along opposite edges of the substantially flat member 18 and define fluid passages in the form of channels 24, 26 on opposite sides of the substantially flat member 18.

In one embodiment of the invention the first substantially flat portion 18 defines slots 19A, 19B directly opposite the second and third channel members 14, 16 respectively. The slots 19A, 19B are to facilitate the manufacture of the inset 10 by a moulding method. It will be appreciated that the slots 19A, 19B can be omitted if the insert 10 is formed using another method.

The second channel member 14 comprises walls 28, 30 extending substantially perpendicularly to a substantially flat portion 32. The walls 30 extend from the substantially flat portion 32 on opposite sides thereof to define fluid passages in the form of channels 34, 36 on opposite sides of the substantially flat portion 32. Intermediate walls 29, extending substantially the length of the second channel member 14, sub-divide the channel 36 into sections 36A, 36B, 36C.

The third channel member 16 comprises a substantially flat portion 38, and walls 40, 42 extending substantially perpendicularly to the flat portion 38 on opposite sides thereof to define fluid passages in the form of channels 44, 46 on opposite sides of the flat portion 38. Intermediate walls 31, extending substantially the length of the third channel member 16, sub-divide the channel 38 into sections 38A, 38B, 38C.

As can be seen from FIG. 1, each of the channel members 12, 14, 16 is elongate. The insert 10 is formed from a suitable rigid plastics material and is provided at one end thereof with a connection member 48 in the form of an extension to the substantially flat member 18. The connection member 48 is used to connect the insert 10 to a spout, as shown in FIG. 2.

Figure 2:
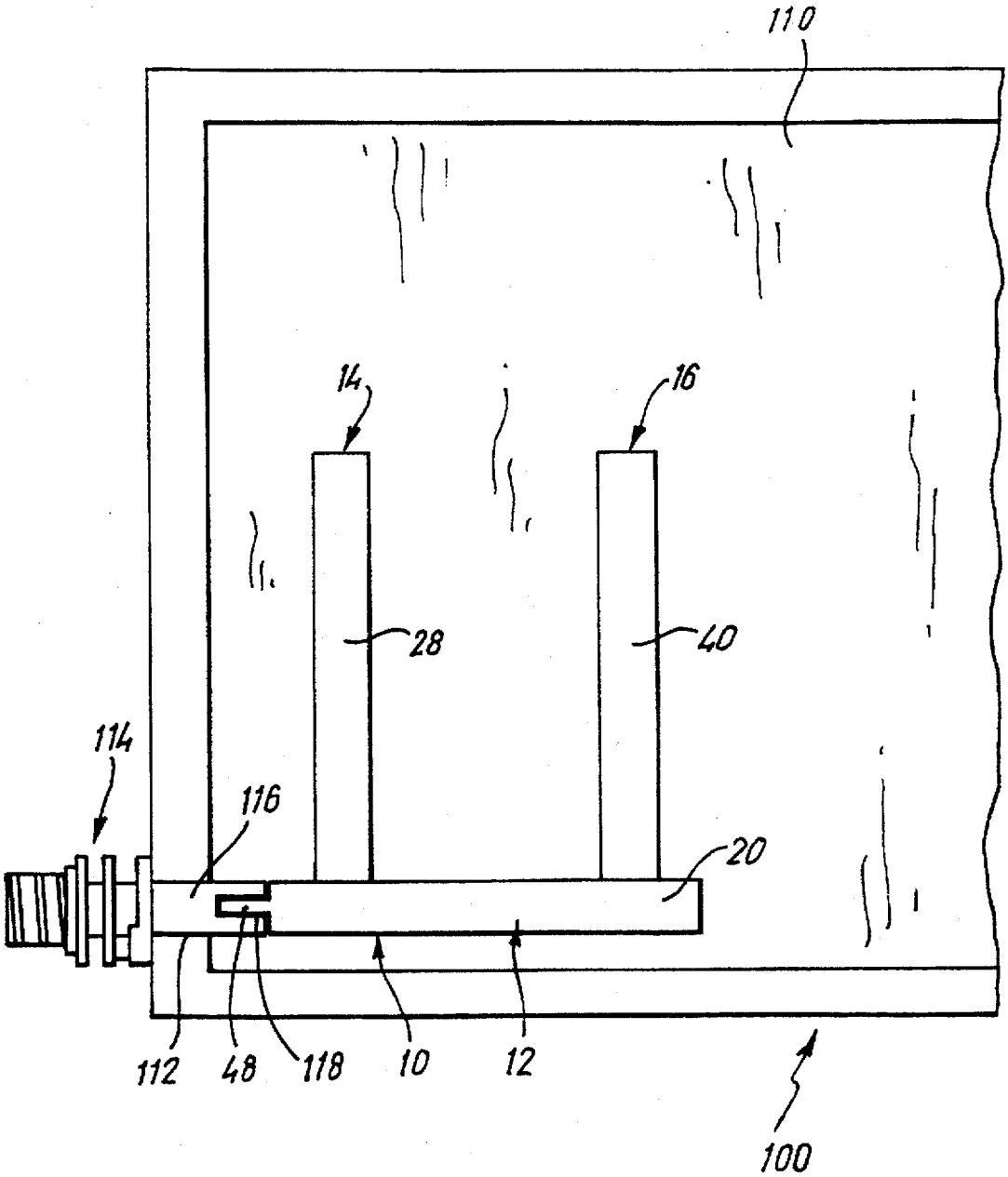
FIG. 2 is a side view of a container with an insert.

Referring to FIG. 2, there is shown a container 100 comprising a vessel in the form of a flexible bag 110, which defines an opening 112 through which fluid inside the vessel 110 can be dispensed. A spout 114 defining a conduit therethrough extends through the opening 112 for connection to a suitable dispensing means (not shown). The container 100 also comprises an insert 10 as described above.

The spout 114 is provided with a connecting element 116 defining a recess 118. The recess 118 receives the connection member 48 on the insert 10, whereby the connection member 48 can be fixedly secured thereto for example by adhesive or other suitable means, such that there is substantially no relative movement between the insert 10 and the spout 114.

The connecting member 48 effectively divides fluid flowing from or to the conduit into an upper and a lower stream.

The container 100 is filled with a suitable fluid material, for example ink which may be of a viscous nature. When the container 100 is almost empty, the sides of the container 100 come into contact with each other thereby creating pockets of fluid. The insert 10 is utilised to keep apart the sides of the container 110 and the channels 24, 26, 34, 36 and 44, 46 provide passages for the fluid remaining in the container 100.

The spacing of the second channel member 14 from the third channel member 16 is proportional to the size of the container, and it is envisaged that the embodiment of the invention described herein will be used with containers having a volume of substantially 600 cc or 1 litre. In a container of 600 cc the spacing between the second and third channel members should be substantially 55 mm. Also, it is preferred that the ratio of a distance between the walls of the channel members and their height is substantially one to four.

Various modifications can be made to the invention without departing from the scope thereof. For example, the insert 10 need not be made separately from the spout 114, but could be made as a one piece moulding.

In a further modification additional longitudinally extending wall member could be located between the outside wall members 20, 22 to divide the channels into two or more sections.

The shape and dimensions of the container can vary and the shape and dimension of the insert will be varied in proportion.

Whilst endeavouring in the foregoing Specification to draw attention to those features of the invention believed to be of particular importance it should be understood that the Applicant claims protection in respect to any patentable feature or combination of features hereinbefore referred to and/or shown in the drawings whether or not particular emphasis has been placed thereon.

I claim:

1. An insert for a collapsible container having an opening, said insert comprising a first member defining a first elongate fluid passage in the form of a generally U-shaped channel adapted to extend from said opening inwardly of the container and adapted to be in fluid communication with said opening, and a second member defining a second elongate fluid passage in the form of a generally U-shaped channel extending transversely from the first fluid passage defined by said first member and being in fluid communication with said first fluid passage.

2. An insert according to claim 1 further including a third member defining a third fluid passage extending transversely from said first member and being in fluid communication with said first fluid passage.

3. An insert according to claim 2 wherein the third member is spaced from the second member and extends from the first fluid member in the same direction as the second member.

4. An insert according to claim 3 wherein the spacing between the second and third members is proportional to the size of the container in a ratio of approximately 1 mm spacing per 11 cc of container volume.

5. An insert according to claim 2 wherein the second and third fluid passage defining members extend substantially perpendicularly from the first member and are substantially parallel to each other.

6. An insert according to claim 2 wherein the first, second and third members are rigid.

7. An insert according to claim 1 including a spout defining a conduit therethrough and adapted to be arranged at the opening wherein the first member is rigidly mounted on said spout with the first fluid passage in communication with the conduit, there being substantially no movement of said first member relative to said spout.

8. An insert according to claim 1 including a spout defining a conduit therethrough and adapted to be provided at the opening, wherein the first member is formed integrally with the spout, with the first fluid passage in communication with the conduit, the spout being in rigid connection therewith.

9. An insert according to claim 2 wherein the third fluid passage is elongate and is in the form of a generally U-shaped channel for the passage of fluid.

10. An insert according to claim 9 wherein each member comprises a substantially flat portion and spaced apart, opposing walls arranged on said flat portion to define a separate, generally U-shaped channel on each side of the flat portion.

11. An insert according to claim 9 wherein intermediate longitudinally extending walls sub-divide at least one of said channels into at least two sections.

12. An insert according to claim 10 wherein the flat portion of the first member extends across a conduit through a spout of the container to divide flow of fluid therethrough into two streams.

13. A collapsible container for a fluid material comprising a flexible vessel for holding said fluid material, an opening for dispensing said fluid and an insert as claimed in claim 1.

* * * * *